US007591031B2

(12) United States Patent
Yang

(10) Patent No.: US 7,591,031 B2
(45) Date of Patent: Sep. 22, 2009

(54) CONTROL DEVICE OF LOWER FRAME ASSEMBLY FOR A PLAYPEN

(75) Inventor: Cheng-Fan Yang, Tainan Hsien (TW)

(73) Assignee: Link Treasure Limited, Tortola (VG)

( * ) Notice: Subject to any disclaimer, the term of this patent is extended or adjusted under 35 U.S.C. 154(b) by 224 days.

(21) Appl. No.: 11/713,006

(22) Filed: Mar. 2, 2007

(65) Prior Publication Data

US 2007/0204400 A1 Sep. 6, 2007

(30) Foreign Application Priority Data

Mar. 2, 2006 (TW) ..... 95203429 U

(51) Int. Cl.
*A47D 7/00* (2006.01)
*A47D 13/06* (2006.01)

(52) U.S. Cl. ..... 5/99.1; 5/93.1

(58) Field of Classification Search ..... 5/99.1, 5/93.1, 98.1–98.3

See application file for complete search history.

(56) References Cited

U.S. PATENT DOCUMENTS 5,279,006 A * 1/1994 Teng ..... 5/99.1
5,497,517 A * 3/1996 Wang ..... 5/99.1
5,542,151 A * 8/1996 Stranski et al. ..... 16/326
5,664,267 A * 9/1997 Cheng ..... 5/99.1
5,761,754 A * 6/1998 Cheng ..... 5/99.1
5,890,263 A * 4/1999 Wu ..... 16/324
5,911,653 A * 6/1999 Cheng ..... 5/99.1
5,970,540 A * 10/1999 Cheng ..... 5/99.1
6,170,099 B1 * 1/2001 Cheng ..... 5/99.1
6,256,814 B1 * 7/2001 Drobinski ..... 5/99.1
6,308,352 B1 * 10/2001 Cheng ..... 5/99.1
6,317,907 B1 * 11/2001 Wang ..... 5/99.1
6,336,234 B1 * 1/2002 Kuo ..... 5/99.1
6,421,850 B1 * 7/2002 Welsh, Jr. ..... 5/99.1
6,615,424 B1 * 9/2003 Cheng ..... 5/99.1
6,711,760 B1 * 3/2004 Yang ..... 5/99.1
6,725,475 B1 * 4/2004 Chen ..... 5/98.1
2002/0184705 A1 * 12/2002 Cheng ..... 5/99.1
2003/0061657 A1 * 4/2003 Longenecker et al. ..... 5/99.1
2007/0204400 A1 * 9/2007 Yang ..... 5/99.1
2009/0019637 A1 * 1/2009 Gehr et al. ..... 5/99.1

* cited by examiner

*Primary Examiner*—Robert G Santos
(74) *Attorney, Agent, or Firm*—Muncy, Geissler, Olds & Lowe, PLLC

(57) ABSTRACT

A control device is pivotally connected with a lower frame assembly of a playpen. The control device has a pair of sleeves, a positioner, a resilient element, a push-button, a driving element, a string. Each of the pair of sleeves has a locking groove with a space for movably receiving the positioner and the resilient element. The positioner can be engaged with the locking groove to inhibit rotation between the pair of sleeves. The resilient element is positioned at one side of the positioner to bias the positioner, thereby keeping the playpen in an unfolded position. A push-button may be pushed to force the positioner to move against the biasing of the resilient element and enter one side of the pair of sleeves. The driving element is pivoted to one of the pair of sleeves to push the push-button. A user can rotate the driving element to push the push-button by pulling a string which is connected to one end of the driving element.

11 Claims, 8 Drawing Sheets

CONTROL DEVICE OF LOWER FRAME ASSEMBLY FOR A PLAYPEN

FIELD OF THE INVENTION

The present invention relates to a control device for a playpen and in particular, to a control device with a string for actuating the folding of the playpen.

DESCRIPTION OF THE RELATED ART

A playpen provides a roomy accommodation for comforting a baby placed inside the playpen. Nevertheless, the roomy accommodations takes up much space for storage. In order to overcome this problem, the current design uses a foldable frame for a playpen.

The configuration of a collapsible base frame for a playpen basically consists of four panels and a base. As the playpen is collapsed, rails of the panels are folded by a joint and closed up to posts of the playpen. This well developed technology is described in U.S. Pat. Nos. 4,811,437 and 5,697,111. Also, in order to fold the entire frame of the playpen, a lower frame assembly is provided with a foldable structure, whereby the entire frame is foldably controlled by the lower frame assembly which is in either a locked or released condition.

For example, U.S. Publication No. 2003/0061657A1 includes a base which is connected to lower supporting rods; the lower supporting rods 20 being relatively confined by a pair of locking members to be fixed in an erected state. The pair of locking members are linked respectively to a piece of cord, and the locking members can be pulled by a band all at the same time, thereby releasing the supporting rods so that they can be folded.

However, in the structure mentioned above, the pair of locking members are moved by pulling a band which is linked to a cord. The supporting rod is released by pulling the pair of locking members via the cord. The pair of locking members should be pulled at the same time through a band in a straight upward direction, or only one locking member can be released since the user pulls the band at a slanted angle. The supporting rods are not released completely if only one locking member is moved and this leads to the disadvantage of failing to fold properly.

The present invention is directed to a collapsible frame for a playpen that substantially obviates the problems of the related art due to the inconvenience of using a band or a handle to simultaneously pull a pair of detached locking members, or the disadvantage of incomplete folding by releasing only one locking member since the user pulls the band at a slanting angle.

BRIEF SUMMARY OF THE INVENTION

The present invention provides an improved control device for a lower frame assembly which can be folded accordingly, wherein the lower frame assembly has a control device disposed between first and second lower frame assemblies; the control device includes a joint controllable by pulling a string to rotate a driving element and pressing a push-button, whereby to manipulate the first and second lower frame assemblies to selectively be in a deployed or folded state in order to achieve the goal of being unfolded and collapsed completely.

It is to be understood that both the foregoing general description and the following detailed description are exemplary and explanatory only and are not restrictive of the invention, as claimed.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

Figure 1:
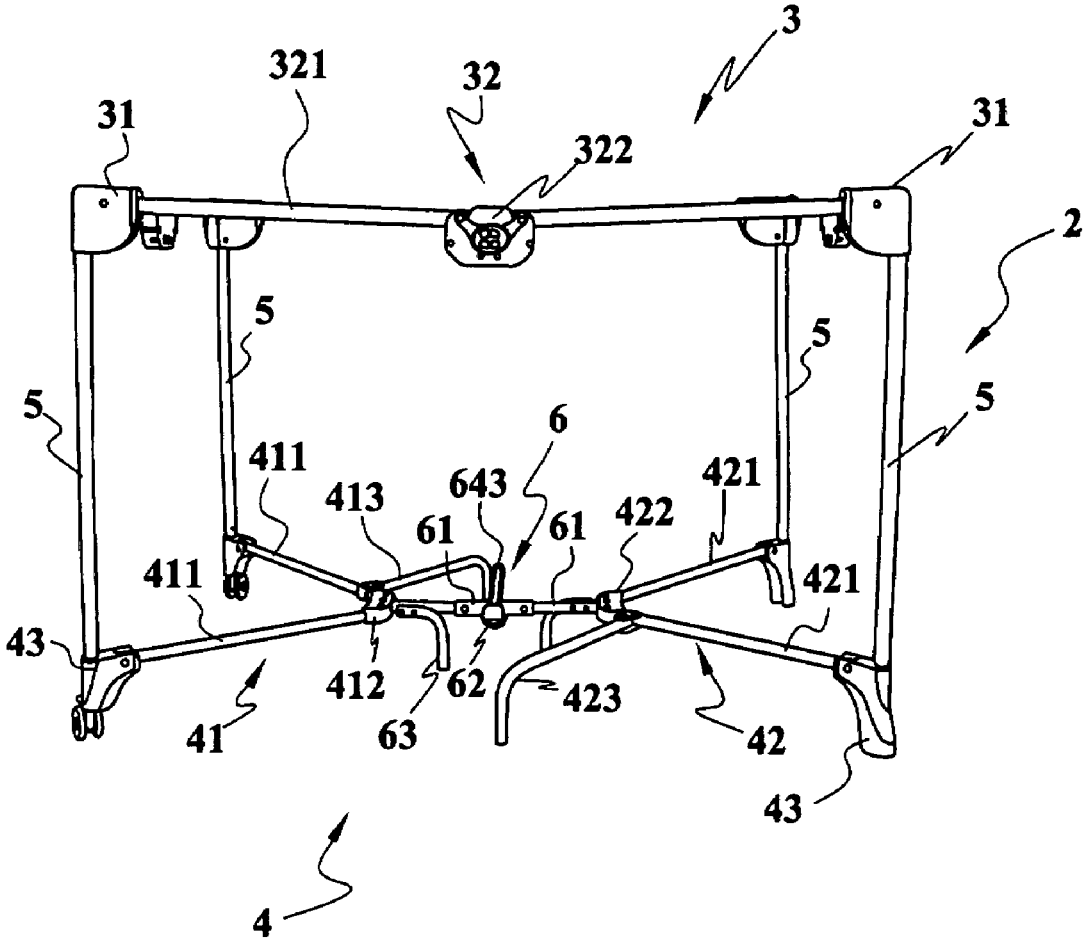
FIG. 1 is a front perspective view of a collapsible frame of a playpen according to one embodiment of the invention.

Referring to FIG. 1, a collapsible frame 2 for a playpen according to the preferred embodiment of the present invention, wherein the playpen includes an upper frame assembly 3 and a lower frame assembly 4.

The upper frame assembly 3 consists of four upper corner housings 31 and a pair of upper rail assemblies 32, wherein the upper corner housings 31 are respectively arranged at four corners of the playpen (for a triangular playpen there would be three corners) and are pivoted to the upper rail assemblies 32, respectively. The upper rail assemblies consists of a pair of rails 321 and a lock assembly 322, whereby the lock assembly 322 aligns the rails 321 when the collapsible frame 2 is in an unfolded state (as shown in FIG. 1) and causes the pair of rails 321 to form a V-shape when the collapsible frame 2 is in a folded state.

The lower frame assembly 4 includes a first lower frame assembly 41 and a second lower frame assembly 42, wherein the first and second lower frame assemblies 41 and 42 are provided with a pair of lower corner bases 43 which are below a respective pair of said upper corner housings 31. An upright post 5 is connected between each upper corner housing 31 and its aligned lower corner base 43.

The first lower frame assembly 41 is connected to a lower end of the upright post 5 on one side of the playpen. In accordance with the present invention, the first lower frame assembly 41 includes a pair of connecting rods 411 and a connecting base 412, wherein one end of each of the pair of first connecting rods 411 are pivotally coupled to a respective said lower corner base 43, and the other ends of the pair of connecting rods 411 are pivotally coupled together at the connecting base 412, so that the lower frame assembly 41 has a generally V-shaped configuration. As shown in this invention, a first supporting rod 413 is additionally pivotally coupled to said other end of the 10 connecting rod 411 and supports the playpen over the ground.

The second lower frame assembly 42 is connected to a lower end of the upright post 5 on the other side of the playpen. According to this invention, the second lower frame assembly 42 has the same configuration of the first lower frame assembly, and includes a pair of connecting rods 421 and a connecting base 422, wherein one end of each of the pair of connecting rod 421 are pivotally coupled to a respective said lower corner base 43, and the other ends of the pair of connecting rods 421 are pivotally coupled together at the connecting base 422 so that the second lower frame assembly has a generally V-shaped configuration. As shown in this invention, a first supporting rod 423 is additionally connected to said other end of the connecting rod 421.

Figure 2:
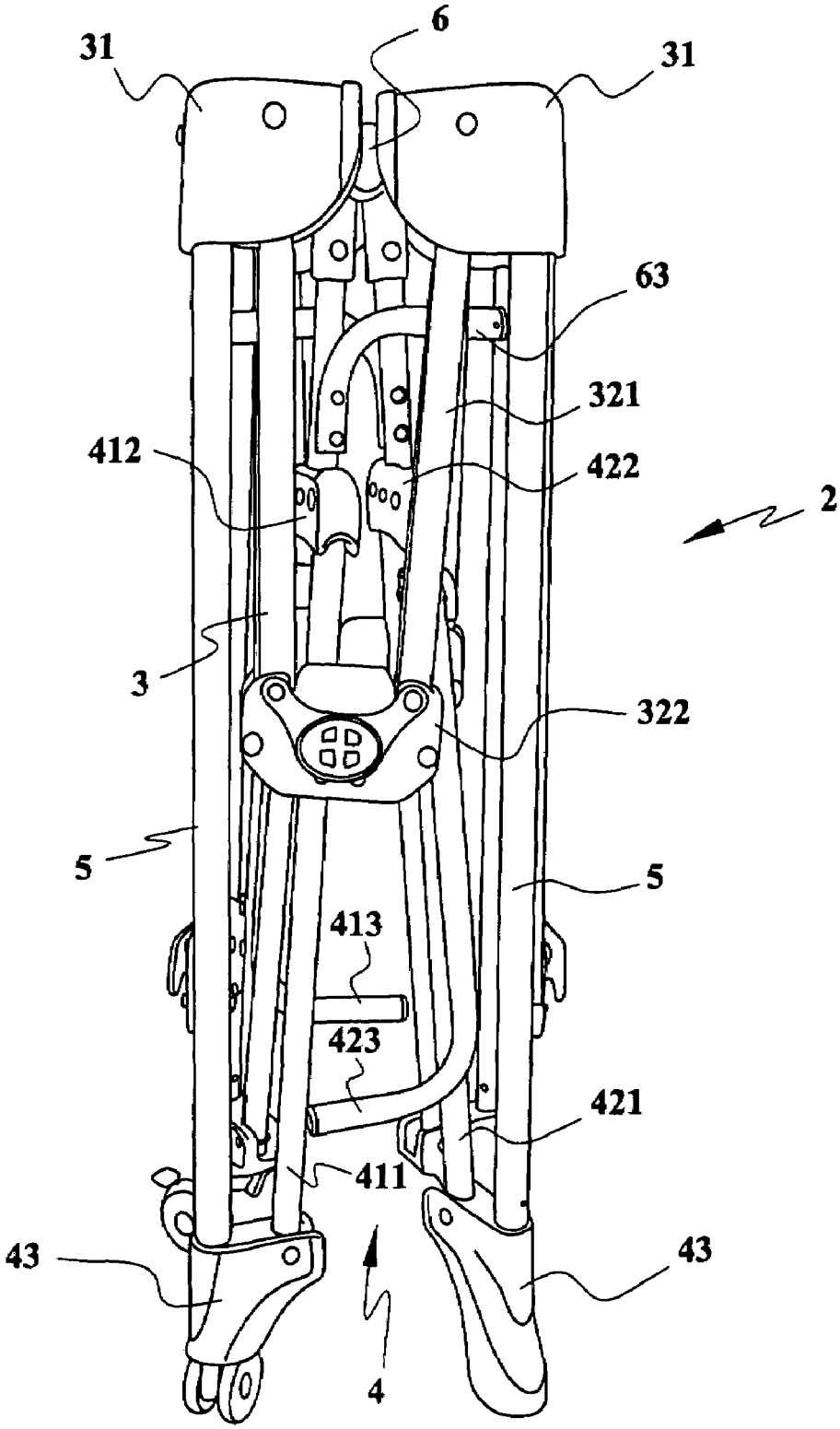
FIG. 2 is a schematic view showing the playpen of FIG. 1 being converted to a collapsed state.
Figure 8:
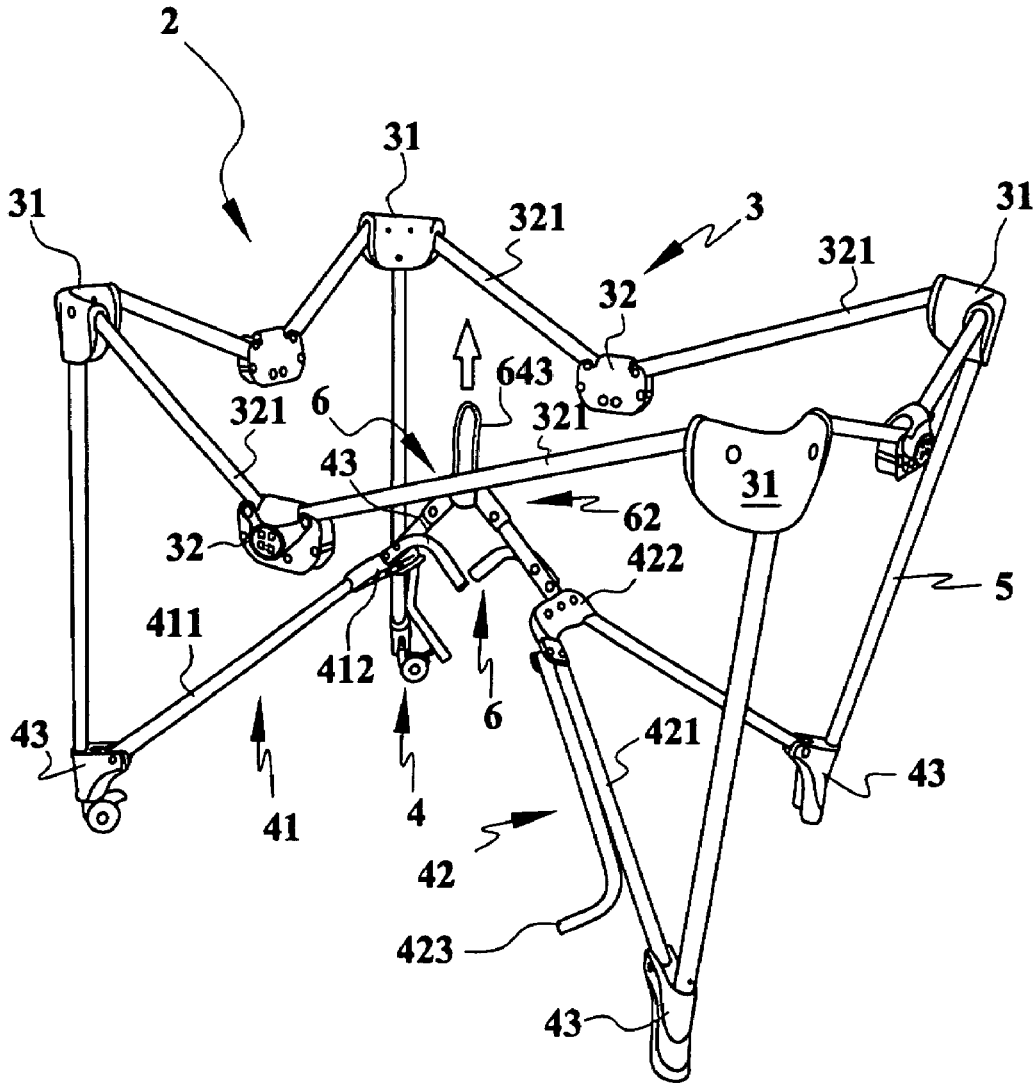
FIG. 8 is a schematic view showing a playpen with a control device according to the invention beginning to convert into a folded state.

Referring now to FIGS. 1, 2 and 8, a control device 6 is pivotally connected between the first and second lower frame assembly 41,42. The collapsible frame 2 includes a pair of connecting rods 61, a joint 62 and a pair of second supporting rods 63. One connecting rod 61 is coupled to, and between, the first lower frame assembly 41 and the joint 62, and the other connecting rod 61 is coupled to, and between, the second lower frame assembly 42 and the joint 62.

Figure 3:
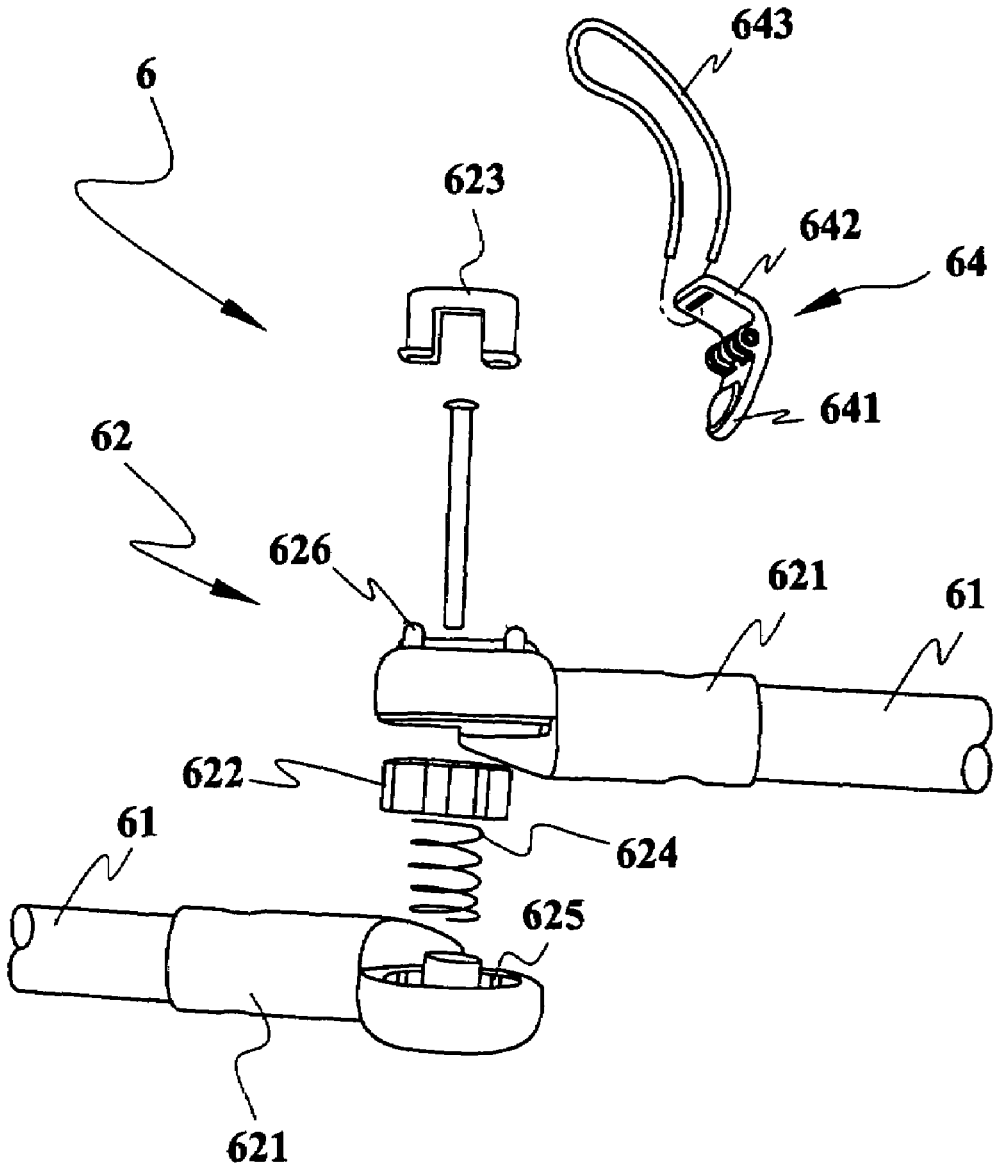
FIG. 3 is an exploded view of an embodiment of the control device according to one embodiment of the invention.
Figure 4:
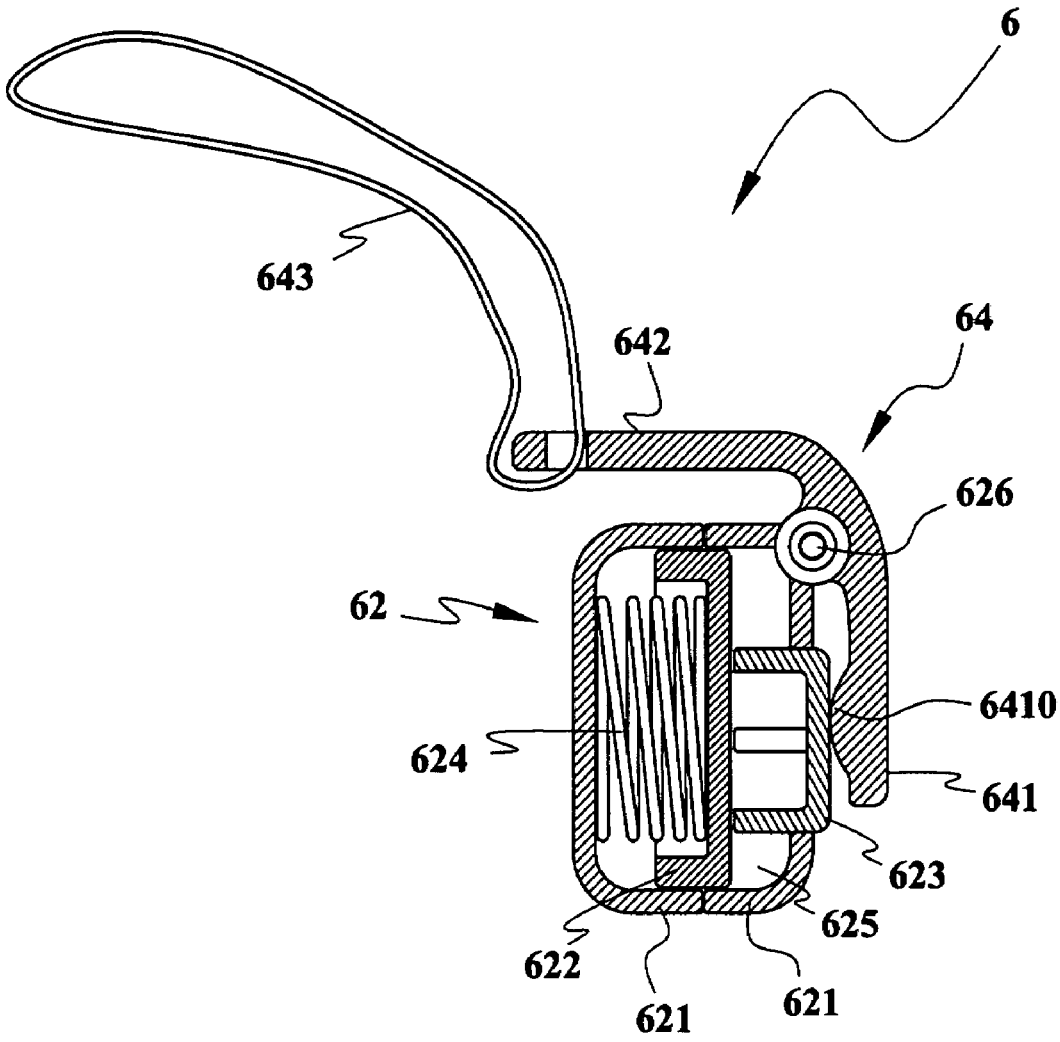
FIG. 4 is a cross-sectional view showing the embodiment of the control device in a deployed or an erected state.
Figure 5:
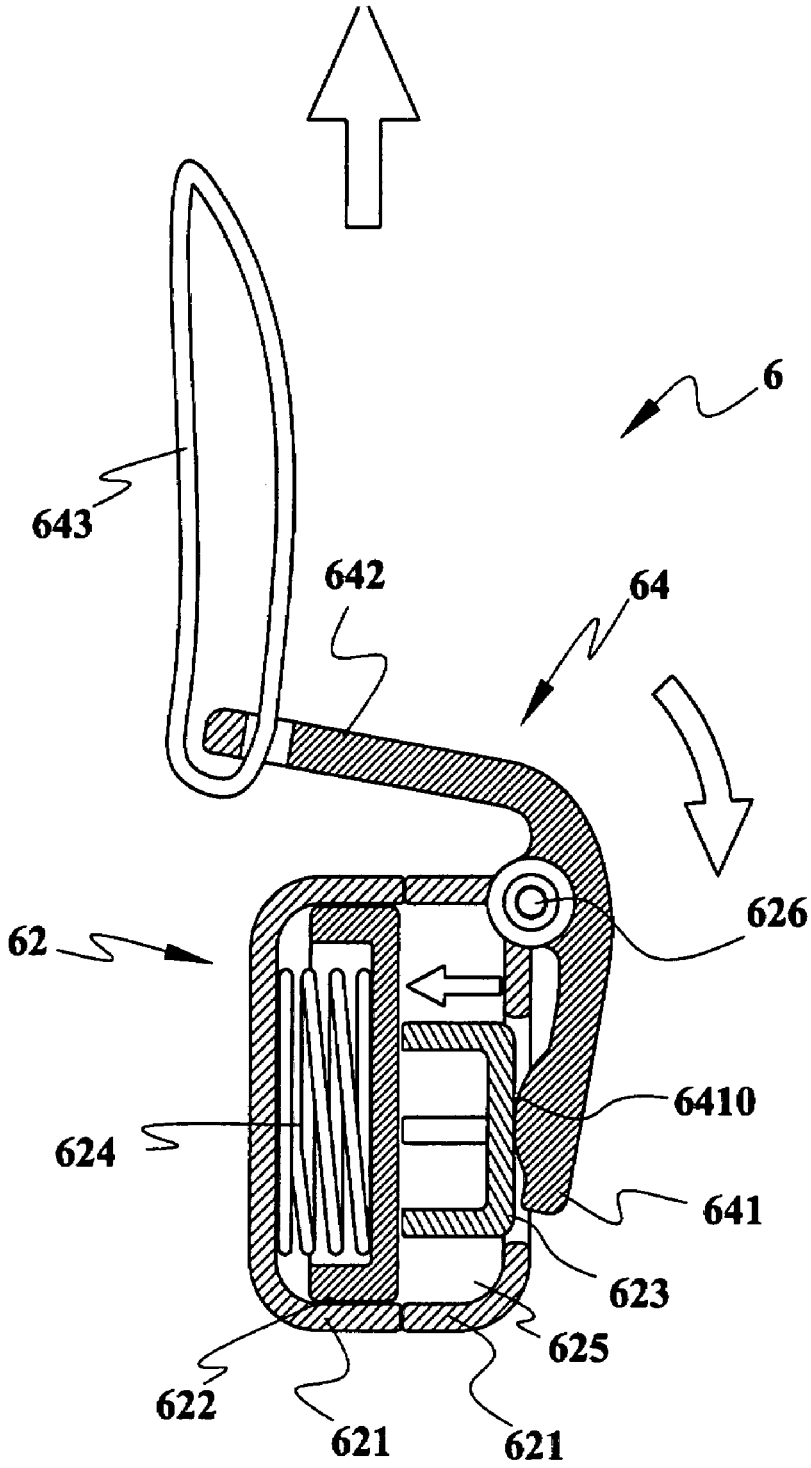
FIG. 5 is a cross-sectional view showing the embodiment of the control device in an actuating position for folding a lower frame of a playpen.

As showing in FIG. 3 to FIG. 5, an embodiment of the control device 6 according to the present invention, includes a pair of sleeves 621, a positioner 622, a button 623, resilient element 624, a driving element 64 and a string 643. The pair of sleeves 621 are pivotally connected to one another and formed as a joint 62. Each of the pair of sleeves 621 is connected with the connecting rod 61 and has a locking groove 625 for accommodating the positioner 622, and the positioner 622 is movable inside the locking grooves 625.

According to the preferred embodiment of this invention, the positioner 622 is a tooth block. As shown in FIGS. 3 and 4, the resilient element 624 is arranged on one side of the positioner 622. In the normal, the resilient element 624 maintains the positioner 622 between the locking grooves 625 of the pair of sleeves 621, and prevents the sleeves 621 from being folded by rotation.

The driving element 64 is pivotablly connected to one of the sleeves 621 at a pivotal portion 626 formed thereon and having a pushing end 641 and a pulling end 642. The pushing end 641 of the driving element 64 is arranged for operatively abutting on the button 623 for moving the positioner 622 against the biasing of the resilient element 624.

The pulling end 642 of the driving element 64 is operatively connected with the string 643. The user is able to pull the string 643 to rotate the driving element 64 so as to press the push-button 623 and forces the positioner 622 to move into the locking groove 625 of the other sleeve 621, so that the sleeves are able to rotate as shown in FIG. 8 so that the frame to enters a collapsible state.

The resilient element 624 in this embodiment can be a compression spring and the string 643 can be formed with a woven fabric. Preferably, the pushing end 641 of the driving element 64 may be formed with extruded portion 6410 for operatively contacting with the center portion of the push-button 623, so as to keep the push-button 623 moving axially without causing unbalance. There is an alternative embodiment shown in FIGS. 6 and 7, wherein the pushing end 641 of the driving element 64 is alternatively formed with a length of extension end 6411 for operatively contacting with the center portion of the push-button 623.

Figure 6:
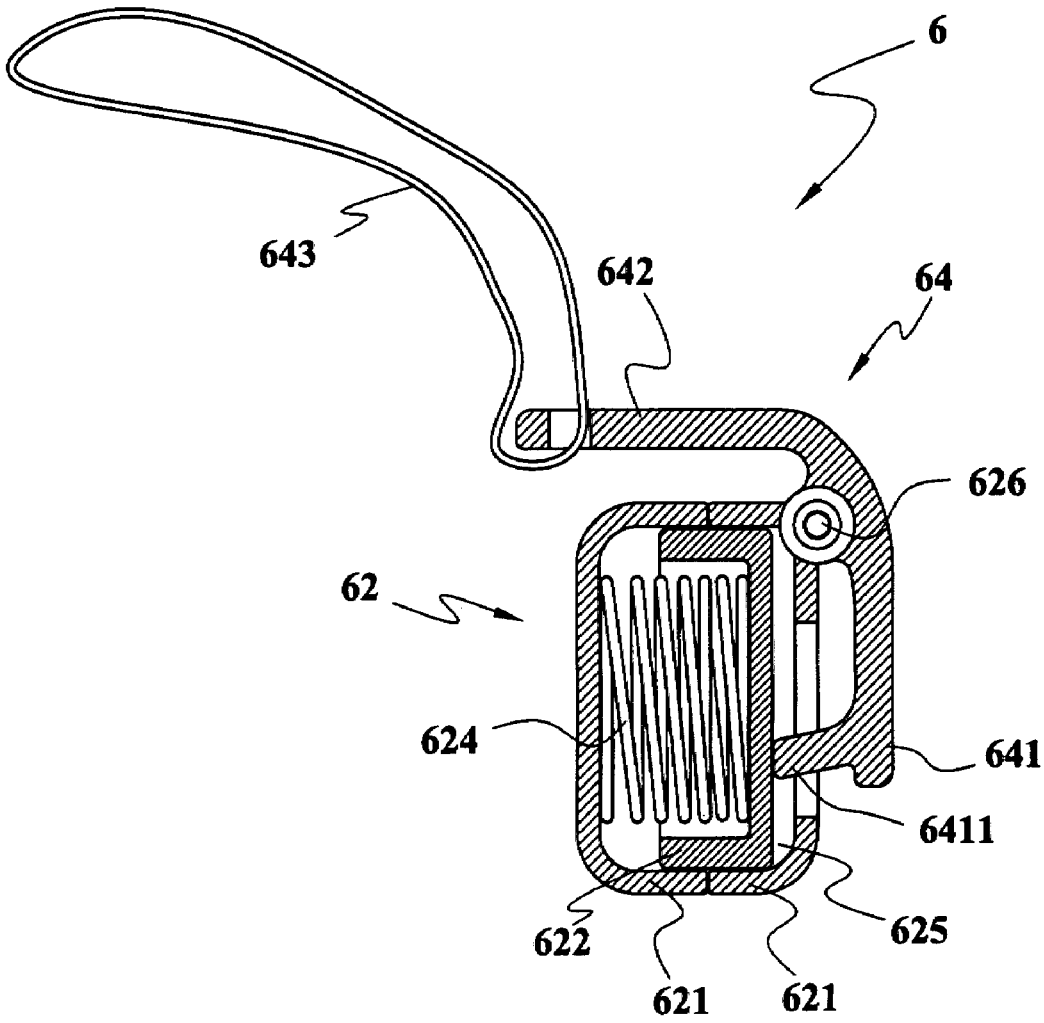
FIG. 6 is a cross-sectional view showing an alternative embodiment of the control device in a deployed or an erected state.

As shown in FIGS. 1, 4 and 6, when the collapsible or foldable frame 2 is fully extended, the positioner 622 of the joint 62 on the lower frame assembly 4 is located inside the locking grooves 625 of the pair of sleeves 621. As the entire collapsible base frame 6 is in a fixed state, the foldable frame 2 is also fixedly deployed.

Figure 7:
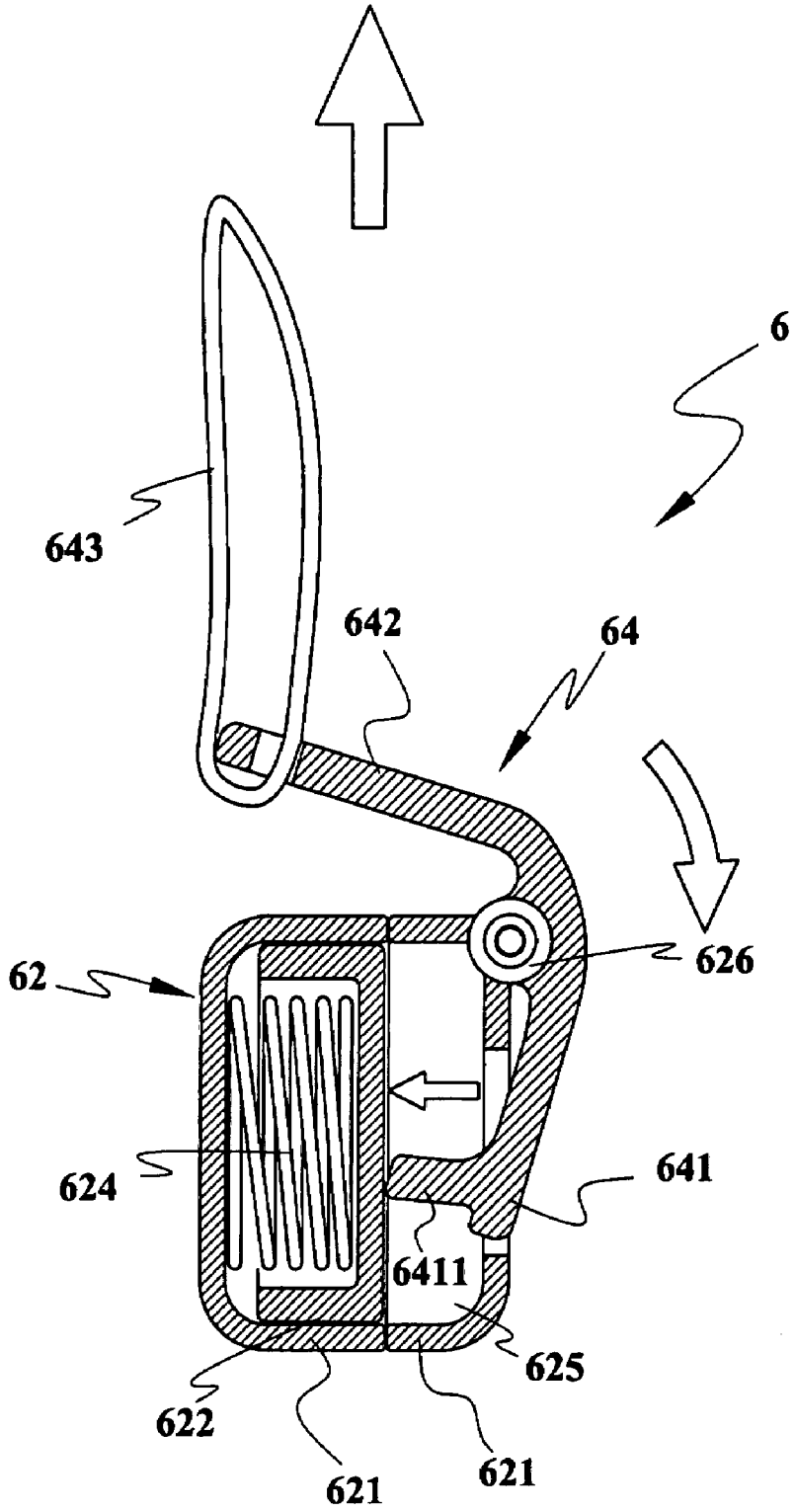
FIG. 7 is a cross-sectional view showing the embodiment of the embodiment of the control device in an actuating position for folding a lower frame of a playpen.

As shown in FIGS. 5, 7 and 8, when the user requires the foldable frame 2 to be folded, the string 643 is pulled. The push-button 623 is pushed by the pushing end 641 of the driving element 64 thereby to push the positioner 622 into the locking groove 625 of the other sleeve 621. As the joint 62 is being folded by rotation, the first and second lower frame assemblies 41,42 are rotated as they are interlinked so that the lower frame assembly 4 is able to fold upwardly as shown as FIG. 8.

A floor member and a flexible cover may be combined with the collapsible frame 2 to form a complete playpen.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control device of a lower frame assembly for a playpen, comprising:

a pair of sleeves, connected to the lower frame assembly of the playpen, each of the pair of sleeves having a locking groove, a positioner, movably received between the pair of sleeves and engaged with the locking groove;

a resilient element, positioned at one side of the positioner for biasing on said positioner to keep the playpen in an unfolded position;

a push-button, for forcing the positioner to move against the biasing of the resilient element and enter one side of the pair of sleeves;

a driving element operatively abutting the push-button wherein one of the sleeves has a pivotal portion for pivotally connecting with the driving element; and a string connected with the driving element, for driving the driving element to push the push-button.

2. The control device of claim 1, wherein the positioner is a tooth block slidably engaged with the locking groove.

3. The control device of claim 1, wherein the driving element has a pulling end for connecting with the string, and is rotatable by pulling the string.

4. The control device of claim 1, wherein the driving element has a pushing end for abutting and pressing on a center portion of the push-button.

5. The control device of claim 4, wherein the pushing end is formed with a protruded portion for contacting a center portion of the push-button.

6. The control device of claim 4, wherein the pushing end is formed with an extended end for operatively contacting with a center portion of the push-button.

7. The control device of claim 1, wherein the playpen has a collapsible frame, and the positioner is kept in a position between the pair of sleeves and biased by the resilient element to inhibit the sleeves from rotating relative to each other when the collapsible frame is in the unfolded position, thereby keeping the collapsible frame, including the lower frame assembly, in the unfolded position.

8. The control device of claim 1, wherein the playpen has a collapsible frame, the push-button is positioned on a side of the positioner opposite the resilient element, and the positioner is arranged to be pushed by the push-button to enter one of the locking grooves, enabling the pair of sleeves to be rotatable relative to each other, thereby allowing conversion of the collapsible frame, including the lower frame assembly, to a folded configuration.

9. The control device of claim 1, wherein the resilient element is a compression spring.

10. The control device of claim 1, wherein the string is formed with a woven fabric.

11. The control device of claim 1, wherein the lower frame assembly includes:

a first lower frame assembly pivotally coupled to a lower end of the playpen;

a second lower frame assembly pivotally coupled to a lower end of said playpen; and a pair of connecting rods for connecting the first lower frame assembly and the second lower frame assembly to the control device.

* * * * *